US005873304A

United States Patent [19]

Ruf

[11] Patent Number: 5,873,304

[45] Date of Patent: Feb. 23, 1999

[54] COMPACTING PRESS

[76] Inventor: Hans Ruf, Tussenhausener Strasse 6, 86874 Zaisertshofen, Germany

[21] Appl. No.: 716,224

[22] PCT Filed: Mar. 9, 1995

[86] PCT No.: PCT/EP95/00883

§ 371 Date: Sep. 10, 1996

§ 102(e) Date: Sep. 10, 1996

[87] PCT Pub. No.: WO95/24307

PCT Pub. Date: Sep. 14, 1995

[30] Foreign Application Priority Data

Mar. 10, 1994 [DE] Germany ..... 44 08 138.3

[51] Int. Cl.[6] ..... B30B 9/30; B30B 15/08

[52] U.S. Cl. ..... 100/97; 100/98 R; 100/215; 100/238; 100/249; 100/269.17; 100/914

[58] Field of Search ..... 100/96, 97, 98 R, 100/137–139, 215, 218, 238, 249, 269.17, 269.18, 914

[56] References Cited

U.S. PATENT DOCUMENTS

| | | | |
|---|---|---|---|
| 2,507,491 | 5/1950 | Crea | 100/218 |
| 3,168,033 | 2/1965 | Hansen | 100/269.17 |
| 3,563,164 | 2/1971 | Carkhuff et al. | 100/98 R |
| 3,651,755 | 3/1972 | Gati | 100/96 |
| 3,913,474 | 10/1975 | Lewis | 100/218 |
| 4,009,838 | 3/1977 | Tashman | 100/97 |
| 4,703,611 | 11/1987 | Young | 100/249 |
| 5,542,348 | 8/1996 | Bendzick | 100/249 |

FOREIGN PATENT DOCUMENTS

| | | | |
|---|---|---|---|
| 7636727 | 10/1977 | Germany . | |
| 674745 | 7/1952 | United Kingdom | 100/269.17 |
| 1201391 | 8/1970 | United Kingdom | 100/249 |
| 1393344 | 5/1975 | United Kingdom . | |

*Primary Examiner*—Stephen F. Gerrity
*Attorney, Agent, or Firm*—Knobbe, Martens, Olson & Bear, LLP

[57] ABSTRACT

A compacting press, in particular for waste paper in offices, has a small footprint and a high pressing density. The press ram is disposed in the vertical direction above a pressed part container. Disposed between a shaping chamber and the pressed part container is a closure slide which can move backwards and forwards in the horizontal direction to close the shaping chamber in the pressing position. The pressed part container is removably arranged on one side of the frame of the hydraulically driven compacting press and takes the form of a rolling container which can hold a plurality of pressed parts and is provided with rollers. The base surface of the container corresponds approximately to the footprint of the compacting press.

28 Claims, 3 Drawing Sheets

COMPACTING PRESS

FIELD OF THE INVENTION

This invention relates to a compacting press for compacting paper material and, more particularly, a compacting press for office use having a small footprint and large storage capacity.

DESCRIPTION OF THE PRIOR ART

Compacting presses in the form of briquette presses are known from DE-PS 3 333 766 and DE-A 3 083 839. A precompression piston is here disposed ahead of a press ram movable horizontally to and fro. The precompaction chamber, into which the precompaction piston extends, is fed by a feeder mechanism, e.g., a feeder auger. The horizontal press ram compacts the material which has thus been slightly precompactcd into a following molding die of disc form, with a plurality of molding chambers. The rear end wall of the rotatable molding die is closed off by a fixed back-plate as a counter-pressure plate against which the horizontal press ram compacts the pressing material. In this known apparatus a briquette compacted in a preceding press operation is ejected from the disc-shaped molding die and then taken off by a stacking device, for example to a conveyor belt.

On account of the horizontally arranged press ram, the known compacting press has a large footprint, which is of little importance in industrial use for compacting leaves or wood waste. For use as a compacting pressure for scrap paper or waste paper in a domestic or office environment however, the footprint plays an important role, as does the ability to provide space-saving interim storage of a large number of pressed parts.

A compacting press of the kind defined is known from US-PS 3 651 755 an in similar form from U.S. Pat. No. 3,563,164. Furthermore, a compacting press is described in WO 93/19930 which does not have any collecting container for interim storage of the pressed parts. In addition, a household press for cans or bottles is known from DE-U 76 36 727, which however only effects destruction of the bottles or cans by means of a piston falling under its own weight but does not provide any permanent forming and compaction. All these apparatuses however have a larger demand on footprint or a space-hungry construction in comparison with the possible interim storage capacity.

Furthermore, presses have been disclosed in the further development of paper shredders or so-called file destroyers, which pass the paper through cutting rollers and then pass it without compaction into a bag, these presses compacting the strips of paper after the chopping in a horizontal extrusion press and eject them sideways into a container. Although further compaction of the strips of paper is thus achieved, a significant footprint is needed, since as well as the press apparatus approximately 1.5 m long, a container is set up with a capacity of around half a cubic meter, so that the container does not have to be emptied too often.

SUMMARY OF THE INVENTION

Accordingly, the invention is based on the object of providing a compacting press which has a small footprint and thus facilitates the most compact dimensions with a high pressing density.

In one embodiment, the present invention provides a compacting press for compacting material, especially scrap and waste paper, comprising, a frame having a footprint, a feed chute mounted on the frame for receiving material to be pressed, a molding chamber mounted on the frame, and a feed device horizontally arranged on the frame for transferring the material from the feed chute to the molding chamber. A press ram arranged along a vertical axis compacts the material in the molding chamber. A container disposed within the footprint of the frame and below the molding chamber receives the pressed material, and a closure slider arranged between the molding chamber and the container is reciprocal between a first position closing the molding chamber from the container and a second position opening the molding chamber to the container.

By arranging the press ram in the vertical direction above a pressed part container for interim storage of the shaped pressed parts, a small footprint is obtained, which is determined essentially only by the area of the container for the interim storage of the pressed parts. The pressed part container takes up about a third of the structural height of the compacting press, so that a capacity of about half a cubic meter results. The compacting press is easy to transport on account of its compact construction. The desired high pressing density is attained in that the molding chamber is closed off in the pressing position by a slider sliding in the horizontal direction. The ejection of the pressed part thus highly compacted in the molding chamber by the press ram itself means that no separate ejection device is needed, so that the manufacturing expense of the compactly structured compacting press remains low.

In a preferred implementation, the closure slider has one or more drive dogs on its underside, which moves the pressed parts away to the side as the pressed part container fills and thus provide for complete filling of the pressed part container. This is effected in advantageous manner at the same time as the closing/opening movement of the closure slider, so that no special drive is needed. The pressed part container is in the form of a rolling container with up to about half a cubic meter capacity in an advantageous implementation, so that emptying only has to be effected infrequently, because of the high pressing density and the complete filling of the container. Overall a compacting press is thus provided which is suited especially for uses in offices as a replacement for file destroyers or shredders, while a plurality of conventional cutting rollers can advantageously also be provided in the region of the filing chute or the feed device.

In a preferred implementation moreover, the side inlet opening to the molding chamber is made asymmetric or off-center relative to the press ram axis, so that a turning moment about the upright axis of the press ram is exerted on the press rain during the pressing movement, so that this turns and thus wears the cutting edge on the underside of the press ram uniformly. In this way a particularly long lifetime for the cutting edge on the lower edge of the press ram is achieved, for shearing off the press material in its transfer from the side inlet opening to the molding chamber.

BRIEF DESCRIPTION OF THE DRAWINGS

An embodiment will be described and explained in more detail below, with reference to the drawings, in which.

DETAILED DESCRIPTION OF THE PREFERRED EMBODIMENT

Figure 1:
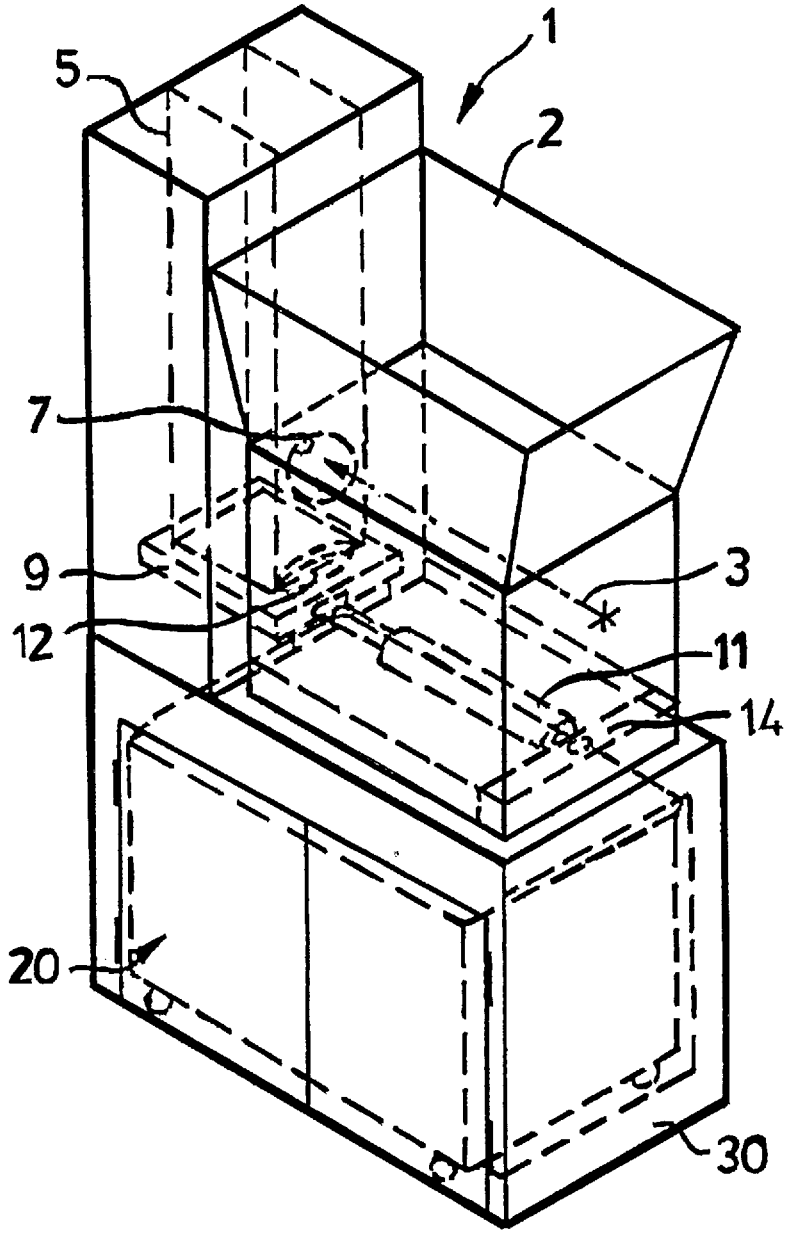
FIG. 1 is a perspective view of a compacting press.

A compacting press 1 is shown schematically in perspective view in FIG. 1, wherein the paper to be compacted, for example old file material, is put into a feed chute 2 essentially from above. Conventional cutting rollers 25 of a shredder can be provided in the lower region of this feed chute 2 (cf. FIG. 2), so that the paper to be compacted is cut into strips. A horizontally disposed feeder device 3 is provided underneath the feed chute 2, for example a conveyor screw or auger which feeds the paper material through a side inlet opening 7 into a molding chamber 6, above which are arranged a press cylinder 5 and a press ram 4 moving up and down in the molding chamber 6, as is shown in more detail in FIG. 2. After feeding the paper material through the side inlet 7, the press ram 4 is lowered several times by actuating the press cylinder 5, whereby the paper material is compacted. A lower outlet opening 8 of the molding chamber 6 is closed for this by a closure slider 9 sliding in the horizontal direction. The closure slider 9 is guided in a machined slider guide 10 (cf. also FIG. 4) and driven to and fro by a slider driver 11, preferably also by a hydraulic cylinder. The drive is effected each time after a predetermined press volume has been reached. The closure slider 9 has a slider opening 12 which has a diameter corresponding to or slightly larger than the cross-section of the molding chamber 6. After moving the closure slider 9 into the discharge position, the slider opening 12 registers with the outlet opening 8 of the molding chamber, so that the pressed part 21 currently pressed in the molding chamber 6 is pushed out by the downwardly moving press ram 4 and can fall down into a pressed part container 20. When the pressed parts 21 pile up in this pressed part container 20 (cf. also FIG. 2), the currently topmost pressed part 21 is moved away to the side by means of each return stroke of the closure slider 9 and one or more drive dogs 13 arranged on the underside, so that complete filling of the pressed part container 20 is achieved. The mounting of the slider unit is effected in a slider frame 14, which is preferably flanged on to the housing of the molding chamber 6, in order to thus achieve reliable support for the forces when moving the closure slider 9. This slider frame 14 is essentially arranged below the region of the feed device 3, whose bottom at the same time forms a cover for the slider frame 14 and can additionally stiffen it. The feed device 3 is driven by a drive motor 15, which is also fixed on the side of the slider frame 14 and is in the form of an electric motor in an advantageous implementation, being switched on on demand, e.g., at a predetermined state of fill of the filling chute 2.

The press cylinder 5 or press ram 4 is driven by a hydraulic pump 17, which is driven by a drive motor 16. The drive motor 16 and the hydraulic pump 17, which is preferably in the form of an internal gear pump, are preferably surrounded by a sound-absorbing casing, so that the compacting press 1 operates with little noise. A contribution to this is also provided if the press cylinder 5 has a pressure transformer 18 at its upper end, connected to the cylinder pump 17 and attached at the side for a small structural height, so that low connection power is needed. Actuation of the pressure transformer 18 known per se and of the slider drive 11 is effected through a displacement detector 19, which is preferably arranged in the center of the press cylinder 5 and which detects the currently attainable depth of penetration of the press ram 4.

Figure 2:
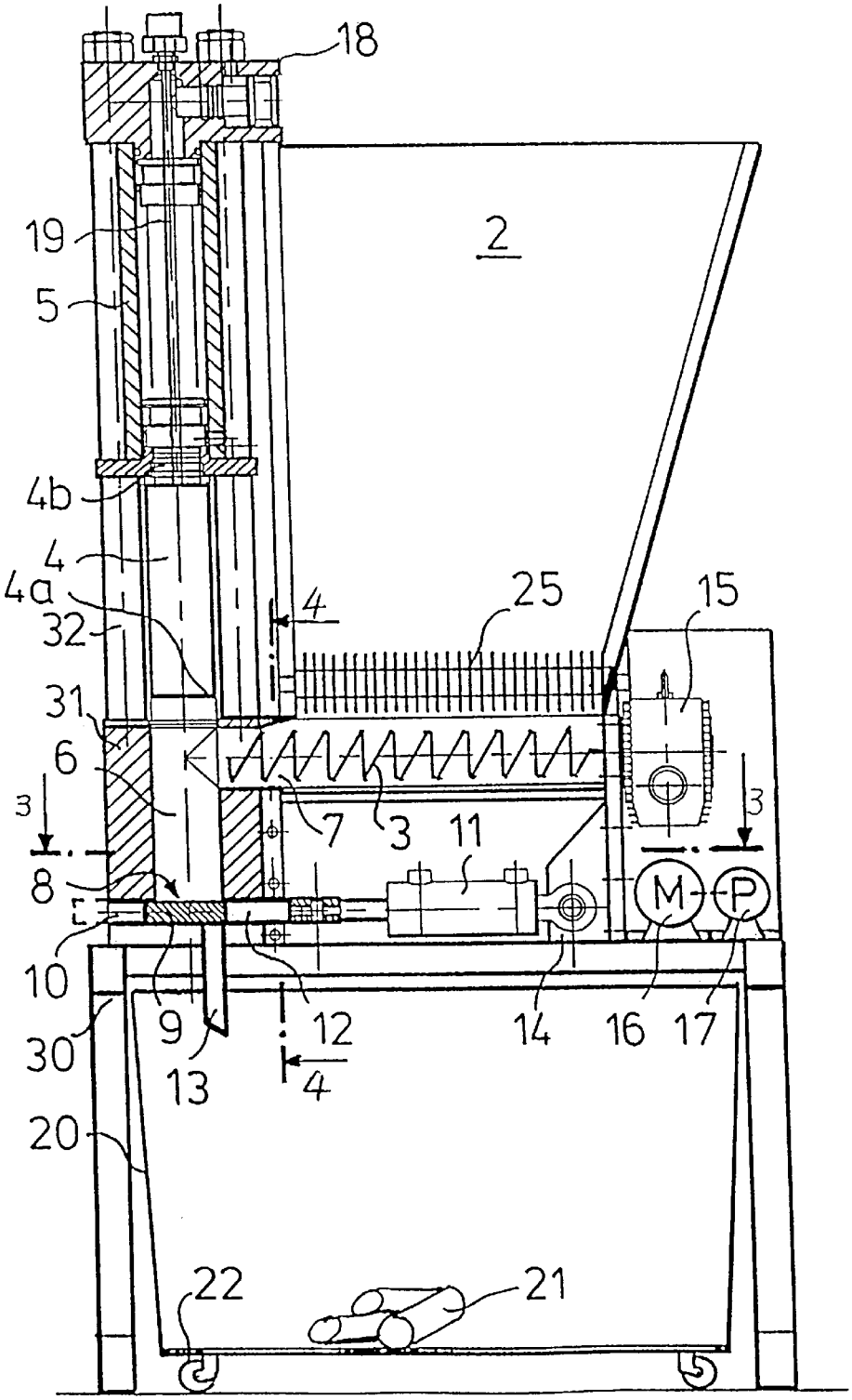
FIG. 2 is a front view of the compacting press, shown partially in section.

A front view of the compacting press 1, shown partially in section, is shown in FIG. 2, wherein the corresponding components described in conjunction with FIG. 1 are given the same reference numerals. The compact construction of the press in particular can be seen from this, especially the small footprint requirement with a pressed part container 20 which has a relatively large capacity for the pressed parts 21. The pressed part container 20 can be pulled out to the front from the front side of the compacting press 1 facing the viewer (arrow D in FIG. 3), a frame under part 30 being open to the front, so that the pressed part container 20 can easily be taken out of the press unit after being filled completely and be emptied, after opening hinged doors 23 according to arrow C in FIG. 3, in the way of a rolling container. The frame under part 30 is preferably built from square tubes, which serve at the same time as an oil reservoir for the hydraulic oil. Above the frame under part 30 is formed the block-form housing 31 for the molding chamber 6, in which are machined the side inlet 7, the lower outlet 8 and the slider guide 10 (cf. FIG. 4). In addition, the slider frame 14 is flanged on to the side on this block-form housing 31 and vertical tie rods 32 for supporting the press cylinder 5 are fixed on the upper side, by means of fixing bores 33. Small structural expense results from this modular mode of construction and easy interchangeability when defects occur.

Figure 3:
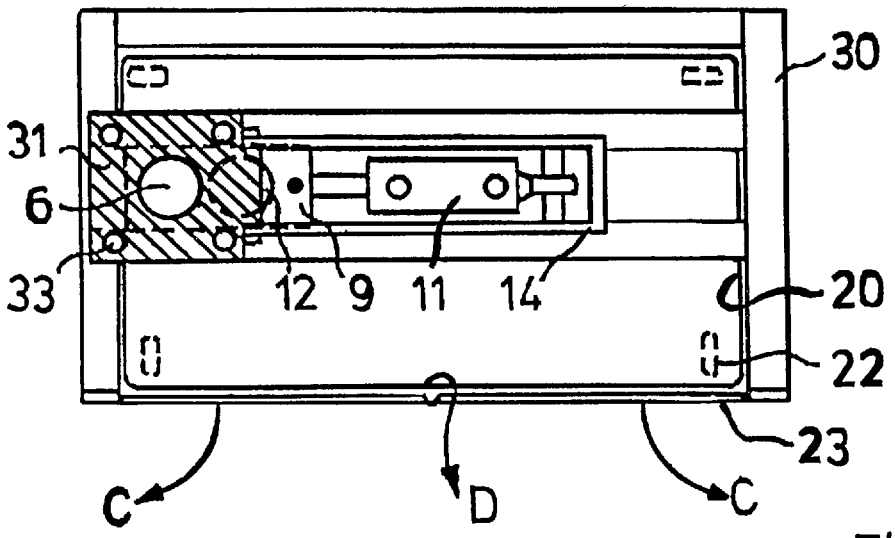
FIG. 3 is a plan view in section on the line 3—3 in FIG. 2.

The plan view along the section line 3—3 is shown in FIG. 3. As well as the frame-like formation of the frame under part 30 for reception of the pressed part container 20 with running rollers 22, the massive design of the housing 31 for the molding chamber 6 is shown and the slider unit with the slider frame 14 attached to the side thereof, the slider drive 11 mounted thereon and the closure slider 9 actuated thereby, with the slider opening 12. The closure slider 9 is here located in the closed position for the molding chamber 6. After the pressed material has been filled through the side inlet opening 7, the pressure ram 4 moves down into the molding chamber 6 and thus compacts the pressed material, especially the scrap paper. After a plurality of such press strokes have been carried out, the attainable depth of penetration of the press ram 4 into the molding chamber 6 becomes ever smaller, which is determined by the displacement detector 19 for example, but which can be determined also by pressure sensors or external measuring systems. Thus, when the press ram 4 now can only penetrate up to approximately the side inlet opening 7 (at the predetermined working pressure), the slider drive 11 is actuated, whereby the slider opening 12 is moved to the left according to FIG. 2, so that it comes into register with the lower outlet opening 8. On the following lowering of the press ram 4, the pressed part 21 formed in the molding chamber 6 is thus pushed down and out of the molding chamber 6. During the following return stroke of the closure slider 9 the pressed part possibly located in the left region of the pressed part container 20 is moved away to the right with the simultaneous reclosing of the molding chamber 6, so that complete filling of the pressed part container 20 can be achieved.

Figure 4:
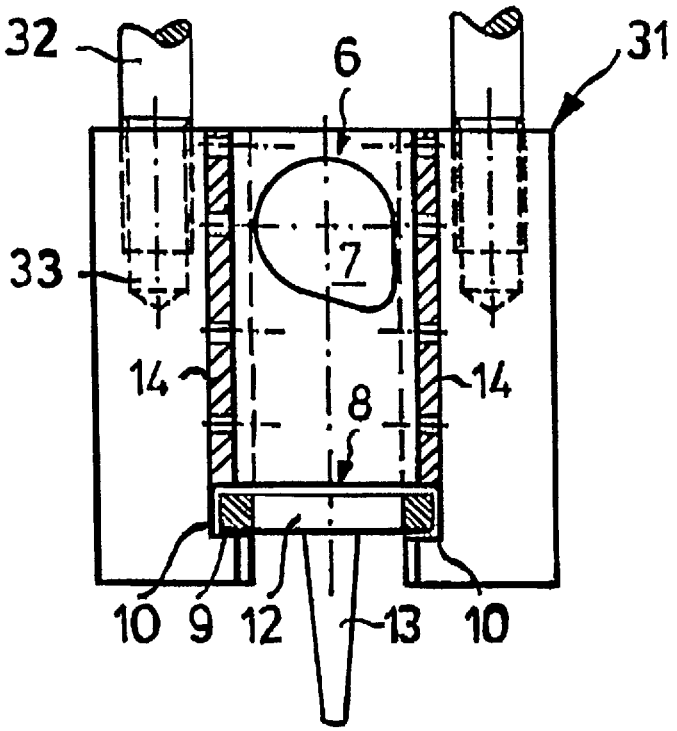
FIG.4 is a side view of the compacting press on the line 4—4 in FIG. 2, likewise partially in section.

The corresponding side view of the housing 31 for the molding chamber 6 is shown in FIG. 4. The guiding of the closure slider 9 in the slider guide 10 is in particular apparent from this, as well as the relatively simple construction. Just as in FIG. 2, the drive dog 13 is shown here, projecting down into the pressed part container 20 and disposed on the underside of the closure slider 9 and which serves for the sideways moving away and thus the fullest possible filling of the pressed part container 20.

Of particular importance is the asymmetric form of the side inlet opening 7, through which the feed device 3 conveys the pressed material, in particular the scrap paper, into the molding chamber 6. Because of this off-center, asymmetric design of the side inlet opening, during the downwards movement of the press ram 4 and thus possibly shearing off of the still attached paper strips, a turning moment is exerted on the press ram 4, so that this turns slightly about its upright axis. This ensures that the cutting edge 4*a* formed on the underside of the press ram 4 is turned on through a few degrees about the upright press ram axis with each press stroke. The lifetime of the cutting edge 4*a* on the underside of the press ram 4 is substantially increased by this. In order to achieve the rotation of the press ram 4, a suitable bearing 4*b* is provided at its top end, about which the press ram 4 can turn freely.

However, it is possible to dispense with this rotary bearing 4*b*, since the press piston associated with the press ram 4 can itself turn in the press cylinder 5. It should be noted that this construction, with stepwise turning of the press ram on account of the asymmetric form of the inlet opening is of special, independent significance and can therefore also be used on other compacting presses.

In connection with FIG. 4, reference is made in particular to the stable attachment of the two side plates (here shown hatched) for forming the slider frame 14, which are flanged on to the massive housing 31 of the molding chamber 6, formed as a block, by a plurality of screws (cf. also FIG. 2 along the section line 4—4), so that a particularly stable construction results, also the further load-bearing parts, namely the tie rods 32 and slider guide 10 fixed or formed thereon.

The inlet opening 7 asymmetric relative to the central axis of the molding chamber 6 is formed like a cam by the radially widening external shape compared with a circular shape in the right, lower region, other shapes being possible, e.g., an off-center displacement or an elliptical shape of the inlet opening 7.

I claim:

1. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged along a vertical axis;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container;

wherein at least one drive dog is arranged on the underside of the closure slider and extends into the pressed part container for moving aside the pressed material piling up in the pressed part container.

2. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged along a vertical axis;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container, wherein the lower part of the frame is in the form of a tubular construction, which is open to one side face for pulling out the container.

3. A compacting press according to claim 2, further including hydraulics for driving the press ram, wherein the lower part of the frame is formed as a hydraulic oil container for the press hydraulics.

4. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged along a vertical axis;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container; and a housing forming the molding chamber and a vertical press cylinder for the press ram having supporting tie rods fixed on the housing.

5. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged along a vertical axis and arranged to rotate freely about its upright axis on a bearing;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container.

6. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged alone a vertical axis;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container; and an inlet opening from the feed chute to the molding chamber formed asymmetrically with respect to a plane through the axis of the press ram.

7. A compacting press according to claim 6, wherein the inlet opening is located off-center with respect to the plane through the axis of the press ram.

8. A compacting press according to claim 6, wherein the inlet opening has a cam shape.

9. A compacting press comprising:

a frame having a footprint;

a feed chute mounted on the frame for receiving material to be pressed;

a molding chamber mounted on the frame;

a feed device horizontally arranged on the frame for transferring the material from the feed chute to the molding chamber;

a press ram for compacting the material in the molding chamber, the press ram being arranged along a vertical axis;

a container disposed within the footprint of the frame and below the molding chamber for receiving the pressed material;

a closure slider arranged between the molding chamber and the container, the closure slider being reciprocal between a first position closing the molding chamber from the container and a second position opening the molding chamber to the container; and rollers provided on the container for portability.

10. A compacting press for compacting material, comprising:

a frame;

a feed chute mounted on the frame for receiving material to be pressed;

a molding chamber mounted on the frame;

a movable closure forming a wall of the molding chamber;

an inlet opening from the feed chute to the molding chamber allowing transfer of material from the feed chute to the molding chamber; and a press ram reciprocal along an axis and sized to fit closely within the molding chamber for compacting the material transferred therein against the movable closure, the press ram having a cutting edge for shearing the material extending through the inlet opening, the inlet opening being formed asymmetrically with respect to a plane through the axis of the press ram so that shearing contact between the cutting edge and the material extending through the inlet opening induces a turning moment on the press ram cutting edge.

11. A compacting press according to claim 10, further including a feed device mounted on the frame for transferring the material from the feed chute through the inlet opening to the molding chamber.

12. A compacting press according to claim 11, further including a shredder mounted in the feed chute for cutting the material into strips before reaching the feed device.

13. A compacting press according to claim 11, wherein the feed device is a screw-type feed horizontally disposed in a lower portion of the feed chute, and the press ram and molding chamber are arranged vertically and perpendicular to the feed device.

14. A compacting press according to claim 10, wherein the inlet opening is located off-center with respect to the plane through the axis of the press ram.

15. A compacting press according to claim 14, wherein the inlet opening has a cam shape.

16. A compacting press according to claim 10, further including:

a bearing allowing the press ram to rotate freely about its axis.

17. A compacting press according to claim 10, further including:

a container disposed below the molding chamber for receiving and storing the pressed material.

18. A compacting press according to claim 17, wherein the press ram and molding chamber are arranged vertically, and the movable closure is located between the molding chamber and the container, the movable closure being reciprocal between a first position closing the molding chamber from the container and a second position opening the molding chamber to the container.

19. A compacting press according to claim 18, further including:

a lower extension of the movable closure for distributing pressed material in the container upon reciprocal motion of the movable closure.

20. An office compacting press for compacting waste material, comprising:

a frame having a footprint;

a feed chute mounted on the frame for receiving material to be pressed;

a molding chamber mounted on the frame adjacent the feed chute for molding material into pressed parts;

a closure for the molding chamber;

a press ram reciprocal along an axis and sized to fit closely within the molding chamber for compacting the material transferred therein against the closure;

an opening from the feed chute to the molding chamber, the opening including means asymmetrically formed with respect to a plane through the axis of the press ram for transferring material into the molding chamber; and a cutting edge on the press ram for shearing the material extending through the opening wherein the asymmetric means transfers material into the molding chamber in a way to cause the press ram to rotate about its axis upon contact between the press ram and transferred material.

21. A compacting press as in claim 20 further comprising:

a feeder for feeding the material from the feed chute to the opening; and a container disposed within the footprint of the frame and below the molding chamber for receiving the pressed parts, and wherein the closure is located between the molding chamber and the container, the closure being reciprocal between a first position closing the molding chamber from the container and a second position opening the molding chamber to the container.

22. A compacting press for compacting material, comprising:

a frame;

a feed chute mounted on the frame for receiving material to be pressed;

a molding chamber mounted on the frame along a first axis adjacent the feed chute;

a closure mounted to reciprocally move in the frame and forming a lower wall of the molding chamber;

an inlet opening from the feed chute to the molding chamber to transfer material from the feed chute to the molding chamber along a second axis generally perpendicular to said first axis, the inlet opening being formed asymmetrically with respect to a plane formed by the first axis and parallel or intersecting the second axis; and a press ram reciprocal in the molding chamber along, and rotatable about, the first axis for compacting the material transferred into the molding chamber against the closure, the press ram having a lower cutting edge in a plane normal to the first axis for shearing the material extending through the inlet opening.

23. A compacting press as in claim 22, further including:

a bearing allowing the press ram to rotate freely about its axis so that shearing contact between the cutting edge and the material extending through the inlet opening induces a turning moment on the press ram cutting edge.

24. A press for compacting paper based material, comprising:

a molding chamber having sides, with an outlet located along a central axis of the chamber, and an inlet opening in the side of the chamber asymmetrically formed with respect to the central axis through which paper based material enters the chamber;

a closure at the outlet to selectively close the chamber outlet;

a feed device providing paper based material to the chamber through the inlet opening;

a ram reciprocating within the molding chamber along the central axis and past the inlet opening to compress paper based material in the chamber when the outlet is closed, the ram having a cutting edge mounted to rotate about the central axis and cooperating with the inlet opening to cut the paper based material and rotate the cutting edge as the ram moves the cutting edge past the inlet opening.

25. A compacting press as defined in claim 24, wherein the closure comprises a slider movable orthogonal to the central axis.

26. A compacting press as defined in claim 24, wherein the feed device comprises a feed mechanism to force paper based material into the chamber.

27. A compacting press as defined in claim 26, further comprising a device communicating with the feed mechanism to reduce the size of the paper based material.

28. A compacting press as defined in claim 24, wherein the compacting press has a footprint, and further comprising a container below the outlet to receive compressed paper based material when the outlet closure is not closing the chamber, the container being within the footprint of the press.

* * * * *

UNITED STATES PATENT AND TRADEMARK OFFICE

CERTIFICATE OF CORRECTION

PATENT NO. : 5,873,304
DATED : February 23, 1999
INVENTOR(S) : Hans Ruf

It is certified that error appears in the above-identified patent and that said Letters Patent is hereby corrected as shown below:

Column 7,
Line 6, which reads "alone", should read -- along --

Signed and Sealed this

Twenty-first Day of May, 2002

*Attest:*

*Attesting Officer*

JAMES E. ROGAN
*Director of the United States Patent and Trademark Office*